US007923663B2

(12) United States Patent
Kim et al.

(10) Patent No.: US 7,923,663 B2
(45) Date of Patent: Apr. 12, 2011

(54) COMPOSITE COOKING APPARATUS

(75) Inventors: Jong Sik Kim, Seoul (KR); Byeong wook Park, Gwangmyeong-si (KR)

(73) Assignee: LG Electronics Inc., Seoul (KR)

( * ) Notice: Subject to any disclaimer, the term of this patent is extended or adjusted under 35 U.S.C. 154(b) by 1149 days.

(21) Appl. No.: 11/612,032

(22) Filed: Dec. 18, 2006

(65) Prior Publication Data

US 2007/0158328 A1 Jul. 12, 2007

(30) Foreign Application Priority Data

Dec. 19, 2005 (KR) ..... 10-2005-0125116

(51) Int. Cl.

| | |
|---|---|
| ***A21B 1/00*** | (2006.01) |
| ***A21B 1/26*** | (2006.01) |
| ***F24C 15/20*** | (2006.01) |
| ***F24C 15/32*** | (2006.01) |

(52) U.S. Cl. ..... 219/391; 219/396; 219/400; 126/21 A

(58) Field of Classification Search ..... None
See application file for complete search history.

(56) References Cited

U.S. PATENT DOCUMENTS

| | | | | |
|---|---|---|---|---|
| 3,783,854 | A * | 1/1974 | Hurko et al. | 126/21 R |
| 3,859,499 | A * | 1/1975 | Evans et al. | 219/396 |
| 4,108,139 | A * | 8/1978 | Gilliom et al. | 126/21 A |
| 4,516,012 | A * | 5/1985 | Smith et al. | 219/400 |
| 4,598,691 | A * | 7/1986 | Herrelko et al. | 126/41 R |
| 4,865,010 | A * | 9/1989 | Kett | 126/21 R |
| 6,234,161 | B1 * | 5/2001 | Levi et al. | 126/21 R |
| 2003/0037780 | A1 * | 2/2003 | Wiersma et al. | 126/21 R |
| 2006/0237425 | A1 | 10/2006 | Kim et al. | |
| 2007/0158328 | A1 * | 7/2007 | Kim et al. | 219/391 |

FOREIGN PATENT DOCUMENTS

KR 10-2000-0025791 A 5/2000

OTHER PUBLICATIONS

KR2000-0025791, Jun. 5, 2000, Kim, partial translation.*
U.S. Appl. No. 11/564,490 to Kim et al., which was filed Nov. 29, 2006.
U.S. Appl. No. 11/609,480 to Kim et al., which was filed Dec. 12, 2006.
U.S. Appl. No. 11/456,979 to Oh et al., which was filed Jul. 12, 2006.
U.S. Appl. No. 11/536,722 to Kim et al., which was filed Sep. 29, 2006.

* cited by examiner

*Primary Examiner* — Joseph M Pelham
(74) *Attorney, Agent, or Firm* — Birch, Stewart, Kolasch & Birch, LLP

(57) ABSTRACT

A cooking apparatus is provided that has an oven cooker and a cook-top cooker. Heat is radiated through a ventilation structure formed by an air inflow duct and an air discharge duct. Additionally, the air inflow duct and the air discharge duct may be stacked one on top of the other, and provided between the oven cooker and the cook-top cooker. Further, the air discharge duct is configured to communicate with an outside, e.g., via a blowing fan unit and an air guide. Further, a cooling capacity can be greatly improved by performing an optimal compulsory cooling according to an operation mode.

16 Claims, 11 Drawing Sheets

COMPOSITE COOKING APPARATUS

This application claims the benefit of Korean Application No. 10-2005-0125116, filed on Dec. 19, 2005, which is hereby incorporated by reference as if fully set forth herein.

BACKGROUND

This description relates to a composite cooking apparatus and, more particularly, to a composite cooling apparatus by which a heat radiating capacity is improved with an improved ventilating structure in a composite cooking apparatus where a free standing oven type cooking apparatus and a cook-top type cooking apparatus are combined in one unit.

Recently, composite cooking apparatuses capable of cooking various foods at one time by using a plurality of cooking means are gradually and widely distributed as various kinds of food are introduced in response to an enhanced standard of living.

FIG. 1 is a schematic view of a typical conventional composite cooking apparatus 200. The typical composite cooking apparatus 200 includes in one unit a free standing oven type cooker 221 and a cook-top type cooker 211 arranged on an upper side of the free standing oven type cooker 200.

As is well known, the oven type cooker 221 includes a chamber 222 disposed therein with a heat source (not shown) such as a heater, and cooks foods with dry heat generated by heating the heat source, after providing the chamber with foods and sealing the chamber. The oven type cooker 221 is largely categorized into three types based on heating method of the heat source, that is, a gas type, an electric type, and a combination type of gas and electric.

Generally, the cook-top type cooker 211 is formed with an electric type cooker of an induction heating method or a heater heating method as illustrated in FIG. 1, or a gas type cooker such as a gas burner.

Therefore, in the conventional composite cooking apparatus 260, a user cooks foods by selectively using an oven type cooker 221 or a cook-top type cooker 211, or by using both of them at the same time.

On the other hand, as illustrated in FIG. 2, a composite cooking apparatus 200 of the conventional art has an air discharge duct 223 for radiation of heat from a chamber of the oven type cooker.

The air discharge duct 223 is arranged within a back guard 201 protruded on the rear part of the oven type cooker, and forms a ventilating structure as an outlet 224 of the air discharge duct 223 is opened toward backward.

In operation of the oven type cooker, the air discharge duct 223 serves to discharge a high temperature heat generated by a heat resource arranged inside a chamber 222 and odor generated in the course of cooking through the outlet 224 by circulating an inner air of the chamber using natural convection.

However, there is a drawback in the conventional composite cooking apparatus 200 thus described in that heat radiating efficiency decreases due to delayed cooling operation, because hot air generated from the chamber of the oven type cooker apparatus 221 is simply discharged to outside through the outlet 224 of the air discharging duct 223 by the natural convection.

There is another drawback in that the composite cooking apparatus 200 of the conventional art has a limitation in the heat radiating efficiency as the cooling operation is further delayed as the discharged heat affects the operation of the cook-top type cooker 211 while passing through the discharge duct 223.

That is, the conventional composite cooking apparatus 200 has a disadvantage that the cooling operation of the cook-top type cooker 211 takes time, as there is no cooling means that cools the cook-top type cooker 211. Danger exists that a second user may get burned by the heat of the cook-top type cooker 211 because of not fully cooled after cooking by a first user due to the delayed cooling operation of the cook-top type cooker 211.

To be more specific, temperature on and of the cook top type cooker 211 itself is very high right after cooking, but there is no way of finding a visible difference between a state of low temperature and that of hot temperature. As a result, a second user may suffer burns if a body part of the second user comes into contact wish the cook-top type cooker 211. Another disadvantage is that foods go bad due to heat if the foods or ingredients thereof are left unattended on the cook-top type cooker 211 while they are not fully cooled.

SUMMARY

The present invention is contrived to overcome the aforesaid problems of the ventilating structure for radiating heat in the conventional composite cooking apparatus, and it is an object of the present invention to provide a composite cooking apparatus by which heat radiating efficiency can be improved with an improved ventilating structure.

Another object is to provide a composite cooking apparatus capable of preventing heat generated from an oven type cooker from being transferred to a cook-top type cooker.

Still another object is to provide a composite cooking apparatus capable of rapidly discharging hot air and odor from a chamber of the oven type cooker.

A composite cooking apparatus comprises: a tree standing oven type cooker; a cook-top type cooker arranged on an upper side of the oven type cooker; a first air inflow duct arranged between the oven type cooker and the cook-top type cooker for communication with an inside of the oven type cooker; a second air inflow duct separately arranged on the oven type cooker in parallel with the first air inflow duct; an air discharge duct communicating with the first and second air inflow ducts, with an outlet arranged upwards of the cook-top type cooker; and a blowing fan unit arranged on a path of the air discharge duct.

The first air inflow duct and the second air inflow duct are stacked in a two-tier structure.

The first and the second air inflow ducts may be substantially arranged on the same height.

In one general aspect, it is preferable that an air direction controller be arranged on the outlet of the air discharge duct.

The wind direction control may include a rotating guide rotatably arranged on the air discharge duct, and a drive unit for rotating the rotating guide.

The rotating guide of a plated shape is hinged at both ends thereof for being rotated at she cutlet of the air discharge duct.

The drive unit includes a motor, a pinion arranged on an output shaft of the motor, a gear member meshed with the pinion and connected to the rotating guide.

In another general aspect, a composite cooking apparatus includes a free standing oven type cooking apparatus; a cook-top type cooker arranged on an upper side of an oven type cooker; a first air inflow duct interposed between the oven type cooker and the cook-top type cooker for communication with an inside of the oven type cooker; a second air inflow duct separately installed side by side with the oven type cooker from the first air inflow duct; a first air discharge duct extensively arranged to the first air inflow duct; a second air discharge duct extensively arranged to the second air inflow duct, and separately installed from the first air discharge duct; a first blowing fan unit arranged on the first air discharge duct, and a second blowing fan unit arranged on the second air discharge duct.

Preferably, the first air inflow duct and the second air inflow duct are stacked in a two-tier structure.

The first air inflow duct and the second air inflow duct may be arranged substantially on the same height (i.e., the first and second inflow ducts may be provided at substantially the same height with respect to a bottom of the cooking apparatus).

Preferably, an air direction controller is arranged on the outlet of the first air discharge duct.

The wind direction control may include a rotating guide rotatably arranged on the air discharge duct; and a drive unit for rotating the rotating guide.

The rotating guide of a plated shape is hinged at both ends thereof for being rotated at the outlet of the air discharge duct.

The drive unit includes a motor, a pinion arranged on an output shaft of the motor, a gear member meshed with the pinion and connected to the rotating guide.

Meanwhile, the second air discharge duct may further include at an outlet thereof with an air guide installed toward the cook-top type cooker.

BRIEF DESCRIPTION OF THE DRAWING

The present invention is further described in the detail description which follows, in reference to the noted plurality of drawings, by way of non-limiting examples of preferred embodiments of the present invention, in which like characters represent like elements throughout the several views of the drawings, and wherein.

DETAILED DESCRIPTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Preferred embodiments of the instant invention will now be described in detail with reference to the accompanying drawings.

Figure 1:
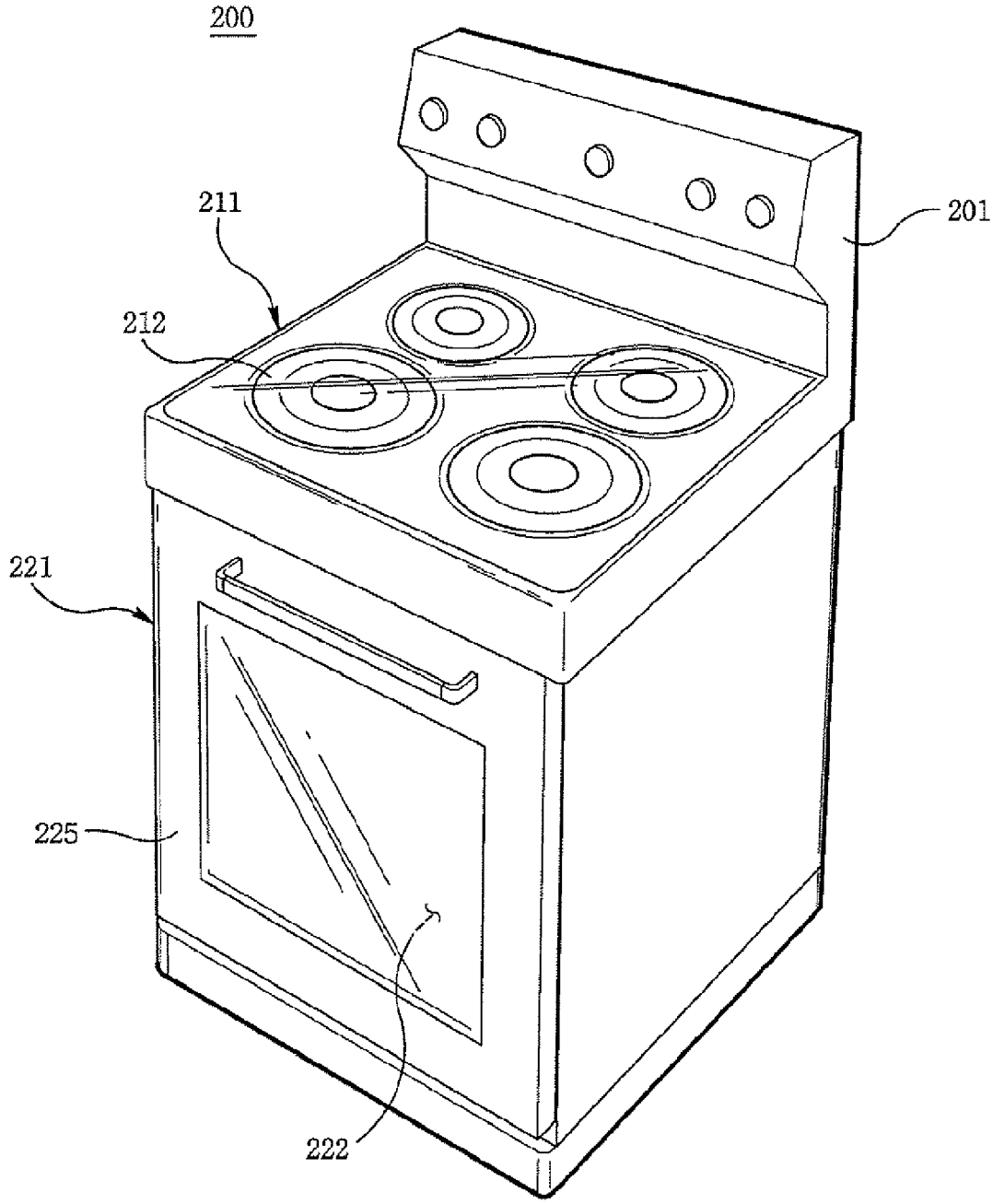
FIG. 1 is a schematic external perspective view illustrating a general composite cooking apparatus according to prior art.
Figure 2:
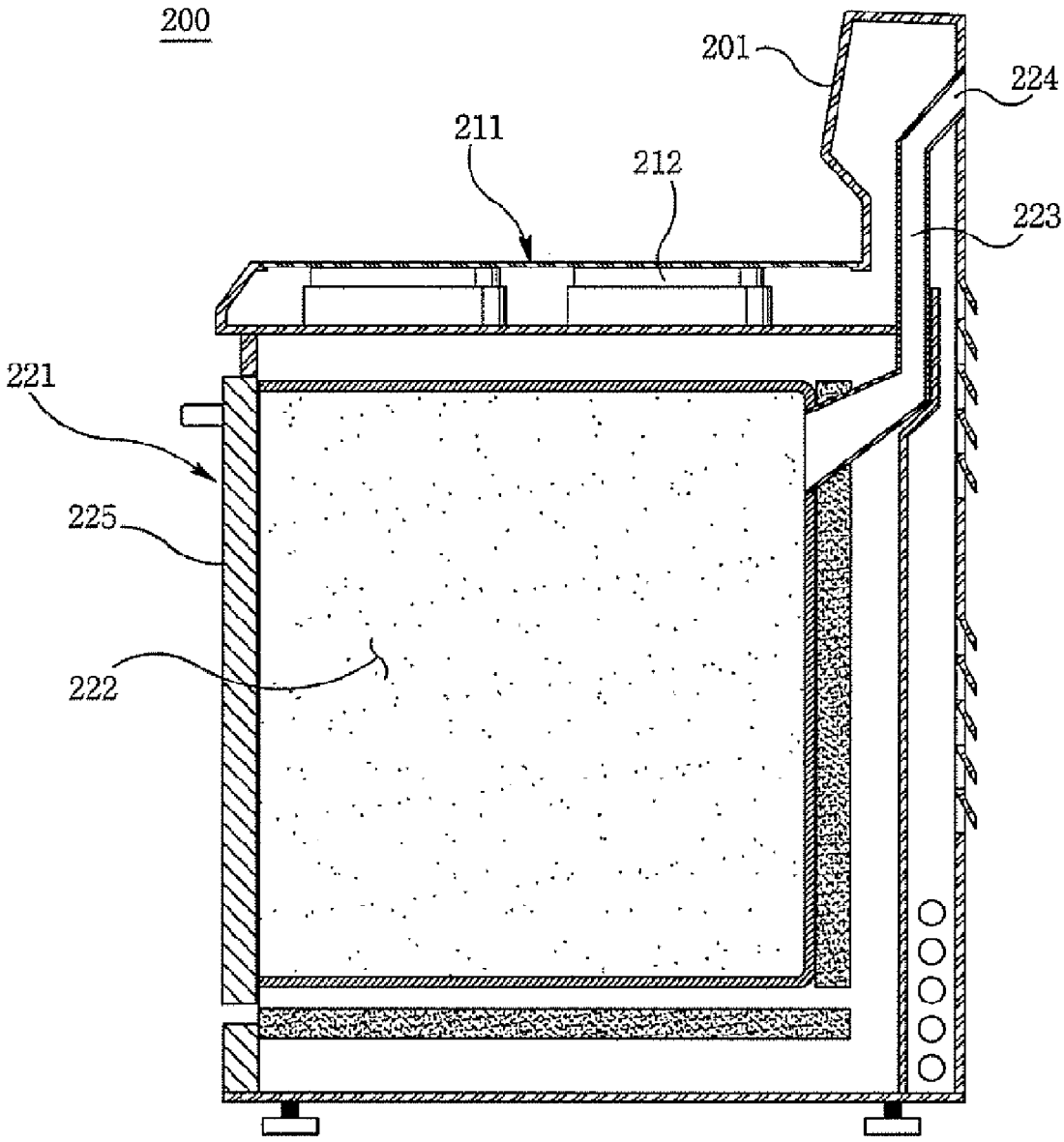
FIG. 2 is a schematic cross-sectional view of the composite cooking apparatus according to the prior art illustrated in FIG. 1.
Figure 3:
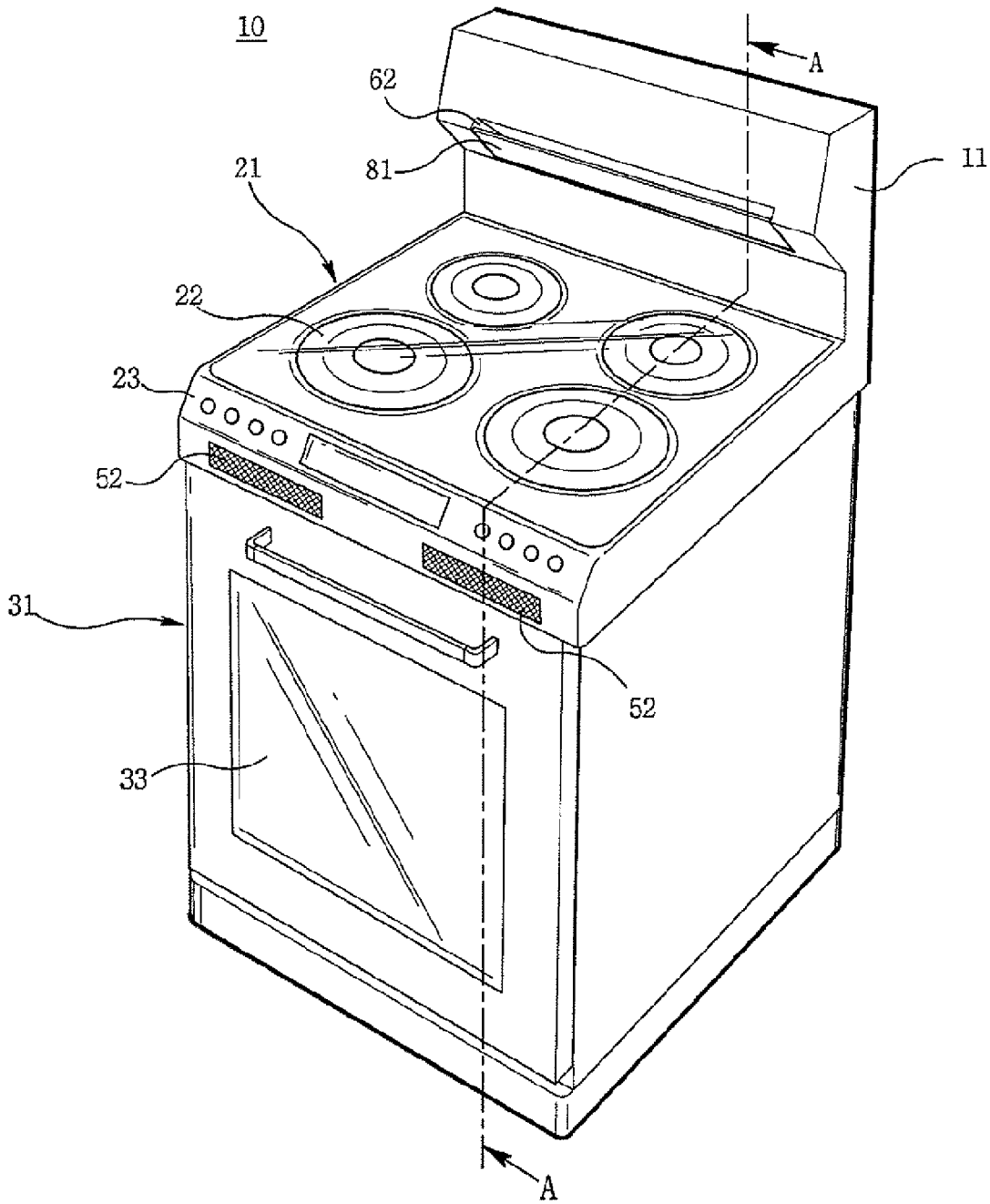
FIG. 3 is a schematic external perspective view illustrating a composite cooking apparatus according to the present invention.
Figure 4:
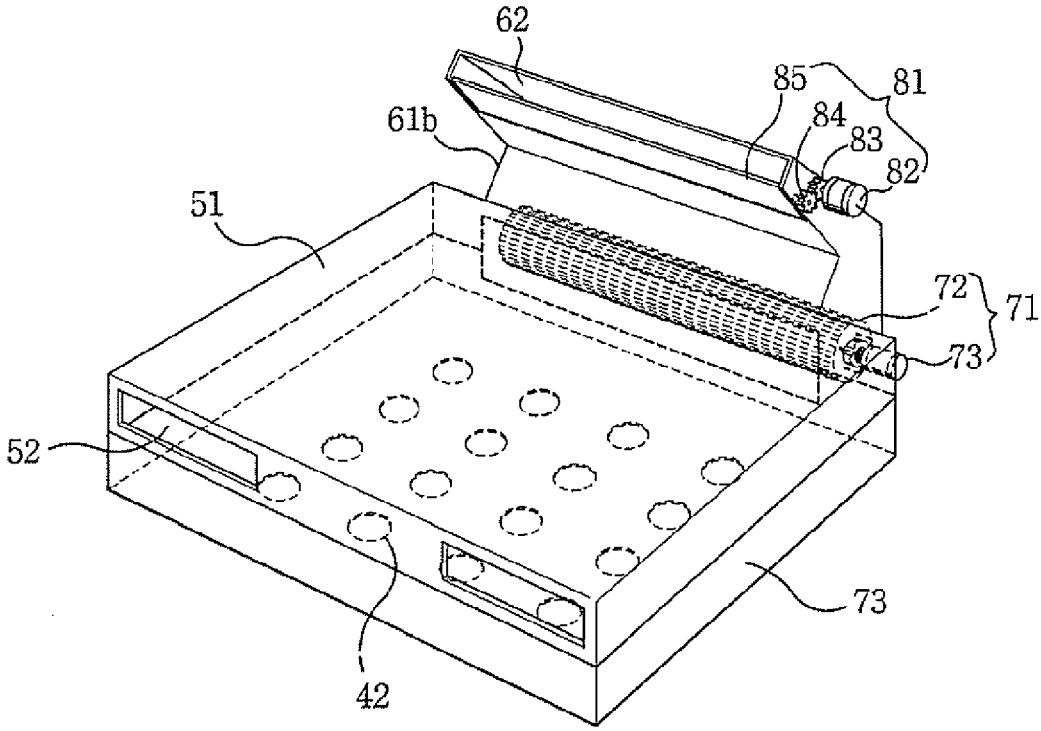
FIG. 4 is a perspective view of an extracted principal part of the composite cocking apparatus illustrated in FIG. 3.
Figure 5:
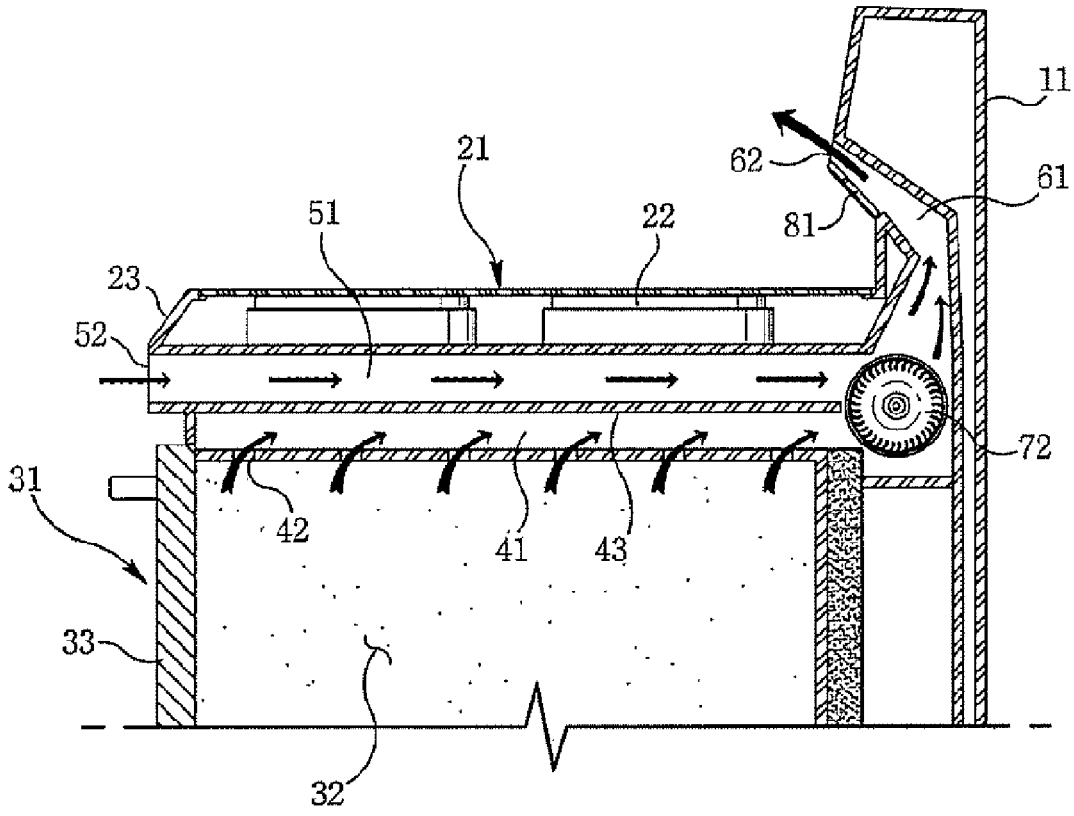
FIGS. 5 and 6 are cross-sectional views taken along line A-A of FIG. 3 to show a structure of a ventilating operation for radiation of the composite cooking apparatus according to the present invention.
Figure 6:
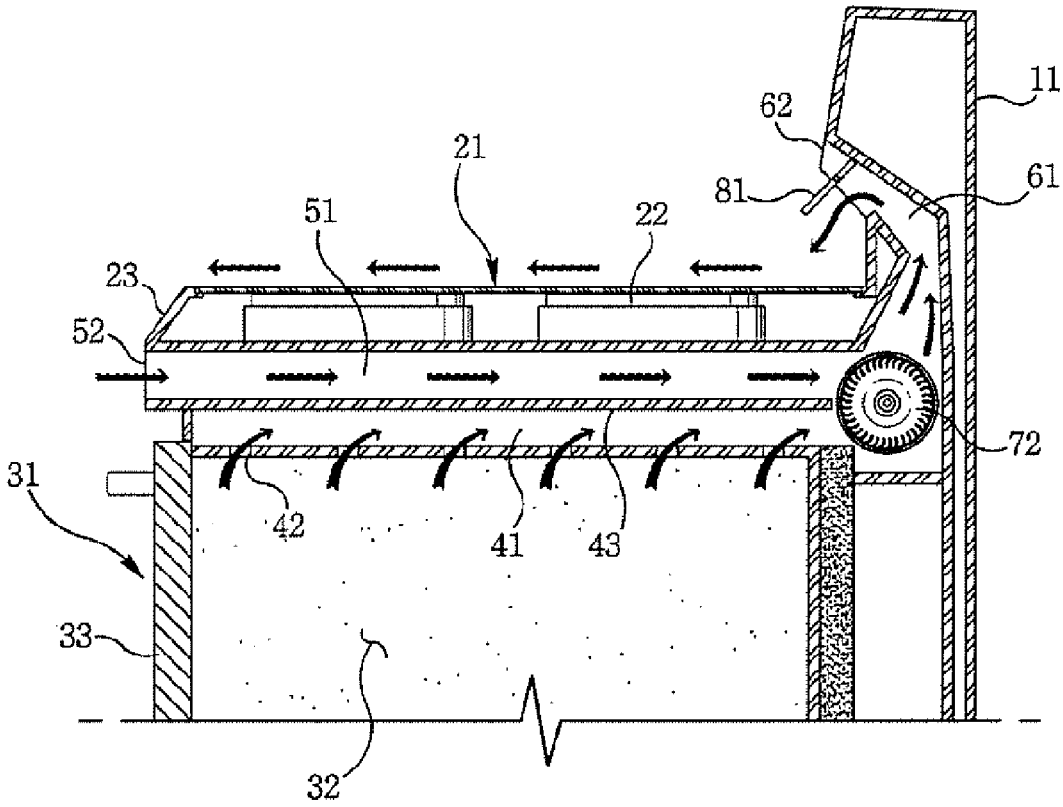

FIG. 3 is a schematic external perspective view illustrating a cooking apparatus according to the present invention, FIG. 4 is a perspective view of illustrating part of the composite cooking apparatus of FIG. 3, and FIGS. 5 and 6 are cross-sectional views taken along line A-A of FIG. 3, where FIG. 5 is a cross-sectional view illustrating a state of radiation in an oven cooker in the composite cooking apparatus, while FIG. 6 is a cross-sectional view illustrating a cooling state of a cook-top cooker in the composite cooking apparatus.

A composite cooking apparatus may include, e.g., a free standing oven type cooker 31 and a cook-top type cooker 21 provided on the free standing oven type cooker 31 in one unit including a first air inflow duct 41 and a second air inflow duct 51 having a ventilating structure for compulsorily cooling the oven type cooker 31 and the cook-top type cooker 21; an air discharge duct 61 formed with a flow path connected to the first and second air discharge ducts 41 and 51; a blowing fan unit 71.

For example, the oven type cooker 31 may be provided with a chamber 32 that is opened or shut by opening or shutting of the door 33, and a heat resource such as a heater may be installed in the inside of the chamber 32. The oven type cooker 31 cooks foods with dry heat generated by heating of heat resource installed in the chamber 32 while the foods are hermetically stored in the chamber 32. The heat source of the heater may be a gas type, electric type, or a combination of gas and electric types. Of course, any suitable cooking arrangement may be employed.

For example, a cook-top type cooker 21 may be installed thereon with an electric cooker 22 heated by an induction heating method or an electric heating method as illustrated in the drawing, or a gas type cooker such as a gas burner. The cook-top type cooker 21 cooks food in a container by heating the container placed on the electric type cooker or the gas type cooker.

The cook-top typo cooker 21 may be disposed at one side thereof with the oven type cooker 31, and a manipulating panel 23 for manipulating the cook-top type cooker 21 and displaying an operating condition of the cooker 21.

The first air inflow duct 41 may be arranged on an upper side of the oven type cooker 3 and nay also be arranged thereunder with a plurality of inflow holes 42 for communicating with the chamber 31 of the oven type cooker.

Therefore, hot air generated from the chamber 32 of the oven type cooker 31 and odor generated in the course of cooking are discharged to outside through the air outlet duct 61 by the operation of the blowing fan unit 71 (described later) after flowing into the first air inflow duct 41 through the inflow holes 42.

The second air inflow duct 51 may be separated from the first air inflow duct 41 by a separating wall.

The second air inflow duct 51 may be provided thereon with an inlet 52 for inhaling an outside air. The inlet 52 may be formed on a front or a side of the composite cooking apparatus (FIGS. 3 and 4), and a protection cover such as a grill may be provided for preventing foreign objects from being introduced from an outside, and the protection cover may also provide an external aesthetically pleasing look. However, it should be appreciated that any suitable arrangement for preventing foreign objects e.g., debris, etc. may be employed.

For example, the first air inflow duct 41 and the second air inflow duct 51 may be formed in a two-tier structure e.g., one on top of the other by providing the second air inflow duct 51 on the first air inflow duct 41.

As the first air inflow duct 41 and the second air inflow duct 51 are formed in the two-tier structure, the transfer of hot air discharged through the first air inflow duct 41 via the chamber 32 of the oven type cooker 31 to the cook-top type cooker 21 may be blocked by the second air inflow duct 51. As a result, the heat radiating effect increases as the bottom of the cook-top type cooker 21 is directly cooled by the outer air flowing into the inside of the second air inflow duct 51.

In another general aspect, it should be appreciate that the first air inflow duct 41 and the second air inflow duct 51 are not limited to the two-tier structure. For example, it is possible for the first air inflow duct 41 and the second air inflow duct 51 to be arranged side by side on the same level between the oven type cooker 31 and the cook-top type cooker 21. Of course, any suitable arrangements of the air flow ducts may be employed An air discharge duct 61 may be connected to a lower part of the first air inflow duct 41 and the second air inflow duct 51.

The air discharge duct 61 may have a path connected to the first air inflow duct 41 and the second air inflow duct 51 for common use, and the air discharge duct 61 may have a single outlet.

Therefore, the air having passed the first air inflow duct 41 and the second air inflow duct 51 may be mixed and discharged through the air discharge duct 61.

The air discharge duct 61 may be installed on a back guard 11 in a substantially vertical direction of the back guard 11 disposed on a rear part of the composite cooking apparatus. The outlet 62 formed on an end of a path of the air discharge duct 61 may be arranged above the cook-top type cooker 21 on a front of the back guard 11.

A blowing fan unit 71 may be provided on a path formed by the first air inflow duct 41, the second air inflow duct 51, and the air discharge duct 61.

The blowing fan unit 71, which may include a blowing fan 72 and a motor 73 for operating the blowing fail 72, inhales air through the first air inflow duct 41, the second air inflow duct 51, and at the same time, discharges the inhaled air by blowing the air into the air discharge duct 61. Here, the blowing fan 72 may be, for example, a sirocco fan or a cross flow fan. Additionally, a guide duct for intaking air may be provided at a periphery of the fan when the blowing fan is a cross flow fan or a sirocco fan.

Further, an air direction controller 81 for controlling an air current direction may be arranged on the outlet 62 of the air cutlet duct 61.

The wind direction control 81 includes a rotation guide 85 rotatably installed on a top periphery of the outlet 62 of the air discharge duct 61, and a drive unit (82 to 84) for controlling a rotating angle of the rotation guide 85.

The rotation guide 85 may be formed in having a generally planar shape and have rotating shafts provided on both ends thereof.

The drive unit (82 to 84) includes an operation motor 82 installed in the back guard 11, a pinion 83 provided on the output shaft part, and a gear member 84 equipped on the rotating shaft of the rotating guide 85 to be engage with the pinion 83.

It should be noted that the wind direction control 81 is not limited by the rotation guide 85 operated by the motor.

In another embodiment (not shown), a rotation guide may be operated by mounting an actuator such as a flexible cylinder and a solenoid inside the back guide 11 and by connecting one side of the rotating guide to a tip end of a rod provided inside the actuator. That is, a rotation angle of the rotation guide 85 may be determined by the rotation guide 85 circling about the rotation shaft as the actuator pulls or pushes said one side of the rotation guide.

Therefore, the rotation angle of the rotation guide 85 may be adjusted by an operation mode to control the blowing direction of the air discharged through the air discharge duct 61.

For instance, when the hot air in the chamber 32 of the oven type cooker 31 is discharged through the outlet 62 of the air discharge duct 61 after passing through the first air inflow duct 41, the air may be exhausted upwards of the back guard 11 when the rotation guide 85 is arranged side by side with the air inflow duct 61.

Further, the rotation guide 85 may be maintained perpendicularly to a direction in which the air discharge duct 61 is arranged, and the air introduced from outside may be discharged to the outlet 62 of the air discharge duct 61 to be blown to an upper surface of the cook-top type cooker 21 in response to the guide of the rotation guide 85, so that the cook top type cooker 21 can be cooled.

Now, the radiating operation for cooling the composite cooking apparatus 10 thus configured will be described in detail with reference to the accompanying drawings.

The cooking may start, e.g., as a power source is applied to the heat source of the oven type cooker 31 or the cook-top type cooker 21 in response to a control signal from a control unit (not shown) when the composite cooking apparatus 10 is manipulated by a user.

The power source may be selectively applied to either the oven type cooker 31 or the cook-top type cooker 21, or may be supplied to both cookers 21 and 31 in response to a user's manipulation.

The blowing fan unit 71 may be sequentially operated upon application of the power source necessary for heating, or may be operated by the selective manipulation of the user.

Generally, the blowing fan unit 71 may be operated for cooling after the oven type cooker 31 and the cook-top type cooker 21 are operated. At this time, the blowing fan unit 71 may be automatically operated once the power is cut off from the cookers 21 and 31, or may be manually operated by the selective manipulation of a user.

Now, referring to FIG. 5, the heat and odor generated by the oven type cooker 31 are discharged by operation of the blowing fan unit 71.

In a case when the oven type cooker 31 is being used, the chamber 32 may be in a state of being heated with heat at a relatively hot temperature.

Under this circumstance, when the blowing fan unit 71 is operated, the air in the chamber 32 starts to be exhausted. When the blowing fan unit 71 starts to operate, the air in the chamber 32 flows into the first air inflow duct 41 through the inflow holes 42 of the first air inflow duct 41, and discharged to outside through the air discharge duct 61. As the air in the chamber 32 is forcibly discharged by the operation of the blowing fan 72, the odor and heat in the chamber 32 can be more swiftly removed or discharged compared with the simple natural exhausting method.

At this time, adjustments may be made in such a fashion that the wind direction control 81 can control the air exhausted from the outlet 62, e.g., to go upwards of the back guard 11. In other words, the air exhausted from the cutlet may go upwards of the back guard 11 when the rotation guide 85 is placed in parallel with an installed direction of the air discharge duct 61.

Furthermore, the outside air may inflow through the second air inflow duct 51 simultaneously as the air is being introduced through the first air inflow duct 41. Subsequently, the air may be discharged to outside through the air discharge duct 61. The heat of the oven type cooker 31 and the first air inflow duct 41 may be prevented from being transferred to the cook-top type cooker 21 due to the second air inflow duct 51 being interposed between the cook-top type cooker 21 and the first air inflow duct 41 through which the hot air flows.

Now, the cooling operation of the cook top type cooker 21 will be described in detail with reference to FIG. 6.

If the cook-top type cooker 21 is heated for cooking, the motor 82 of the wind direction control 81 is operated to allow the rotation guide 85 to be arranged perpendicular to the installation direction of the air discharge duct 61. Because the air discharge duct 61 is mounted upward, the air discharged from the outlet 62 flows to the cook-top type cooker 21 when the rotation guide 85 is rotated perpendicularly to the air outlet duct 61 as illustrated in FIG. 6.

When the blowing fan unit 71 is rotated under the condition that the location of the rotation guide 85 is controlled, the outside air blown through the inlet 52 may be discharged to the cook-top type cooker 21 under the guidance of the rotation guide on the outlet 62 after sequentially passing through the second air inflow duct 51, the blowing fan unit 71, and the air discharge duct 61. Therefore, the cook-top type cooker 21 can be cooled much faster with the assistance of the outside air introduced into the second air inflow duct.

At this time, because the air also flows in through the first air inflow duct 41, the air that has introduced in through the first air inflow duct 41 and the air that has come in to the second air inflow duct 51 from the air discharge duct 61 are mixed for use in cooling the cook-top type cooker 21 when the oven type cooker 31 is not operated.

Therefore, the composite cooking apparatus 10 can cool the oven type cooker 31 or the cook top type cooker 21, or cool both of them at the same time according to selection of one of the operation processes described in FIGS. 5 and 6.

Figure 7:
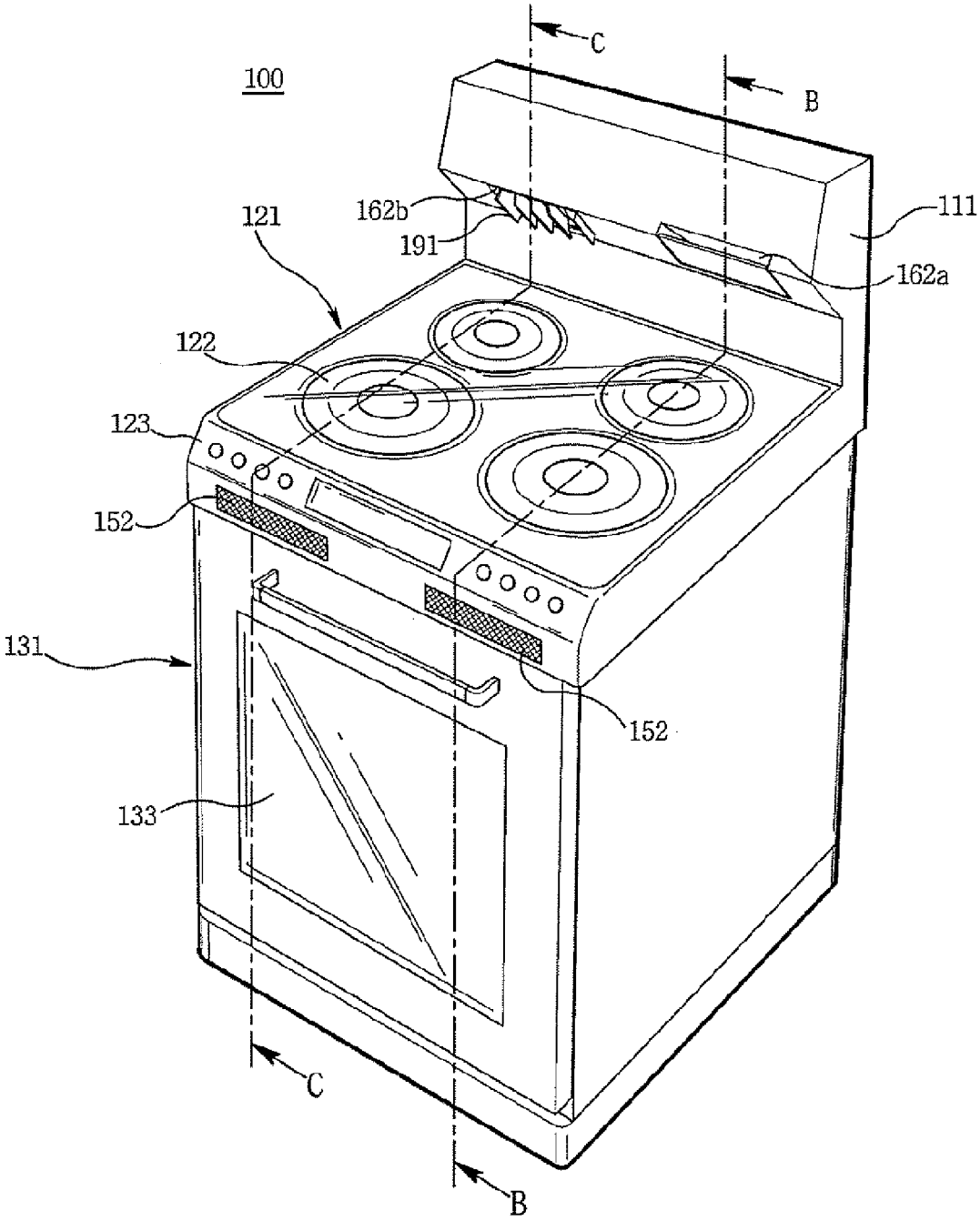
FIG. 7 is an external perspective view illustrating a composite cooking apparatus according to another embodiment of the present invention.
Figure 8:
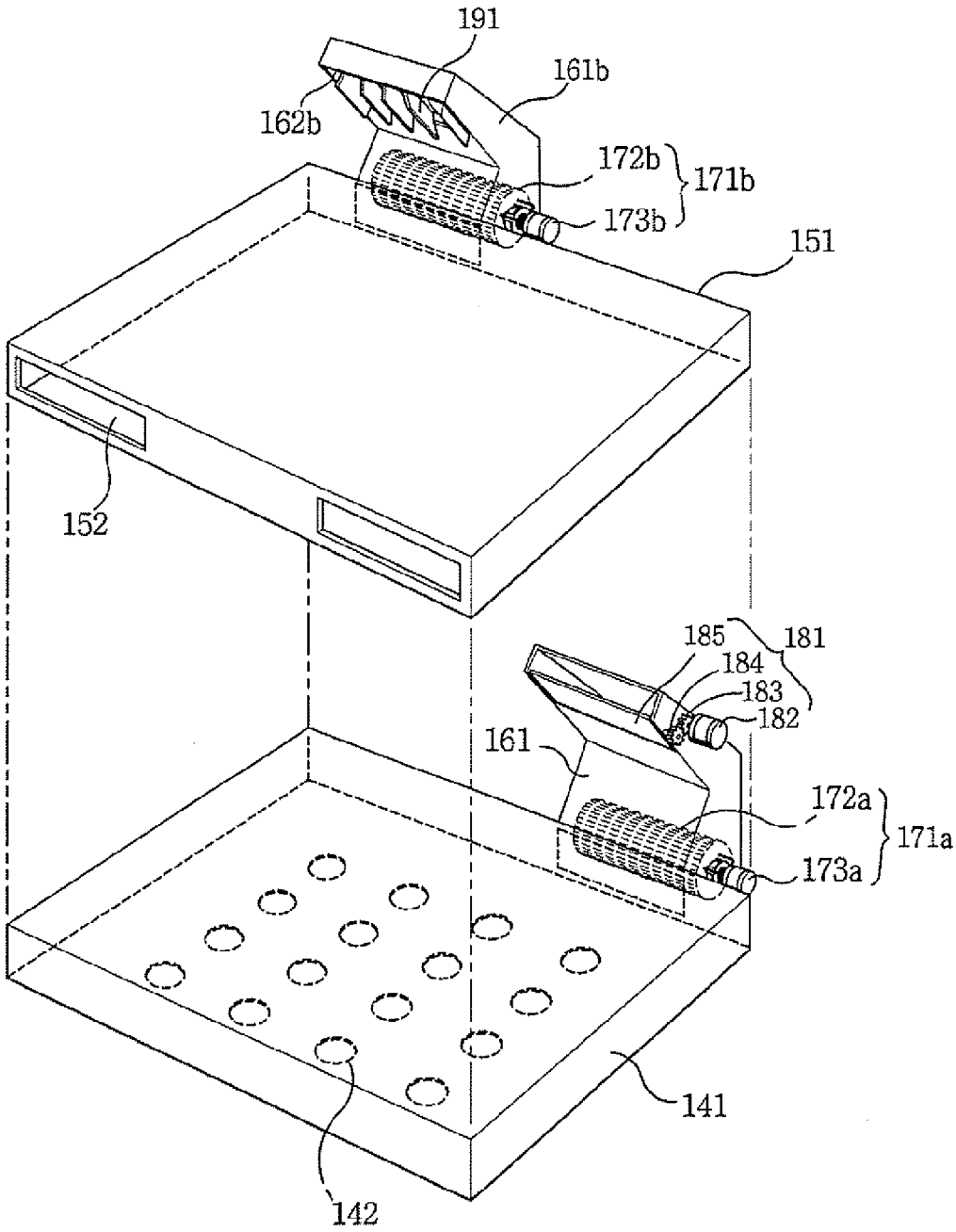
FIG. 8 is a perspective view of an extracted principal part of the composite cooking apparatus illustrated in FIG. 7.
Figure 9:
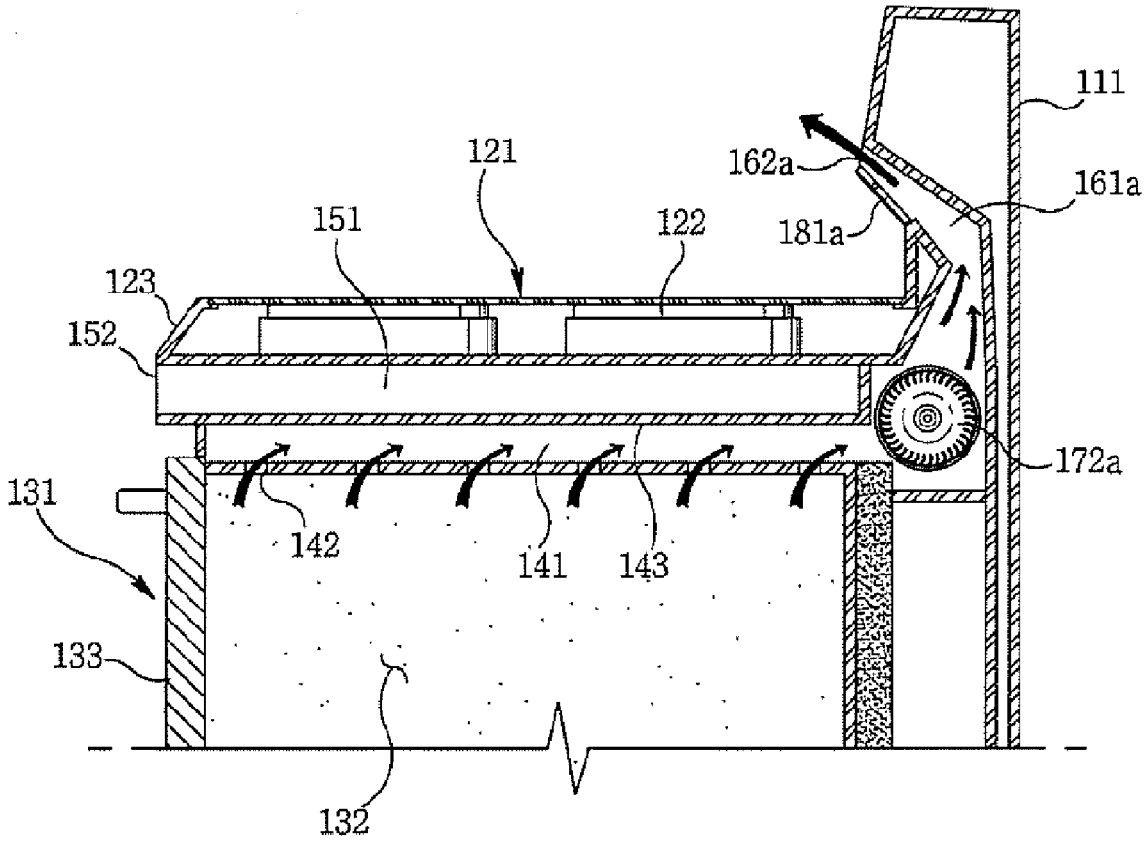
FIGS. 9 and 10 are cross-sectional views of a principle part taken along line B-B to show a structure and a ventilating operation for radiation of the composite cooking apparatus illustrated in FIG. 7.
Figure 10:
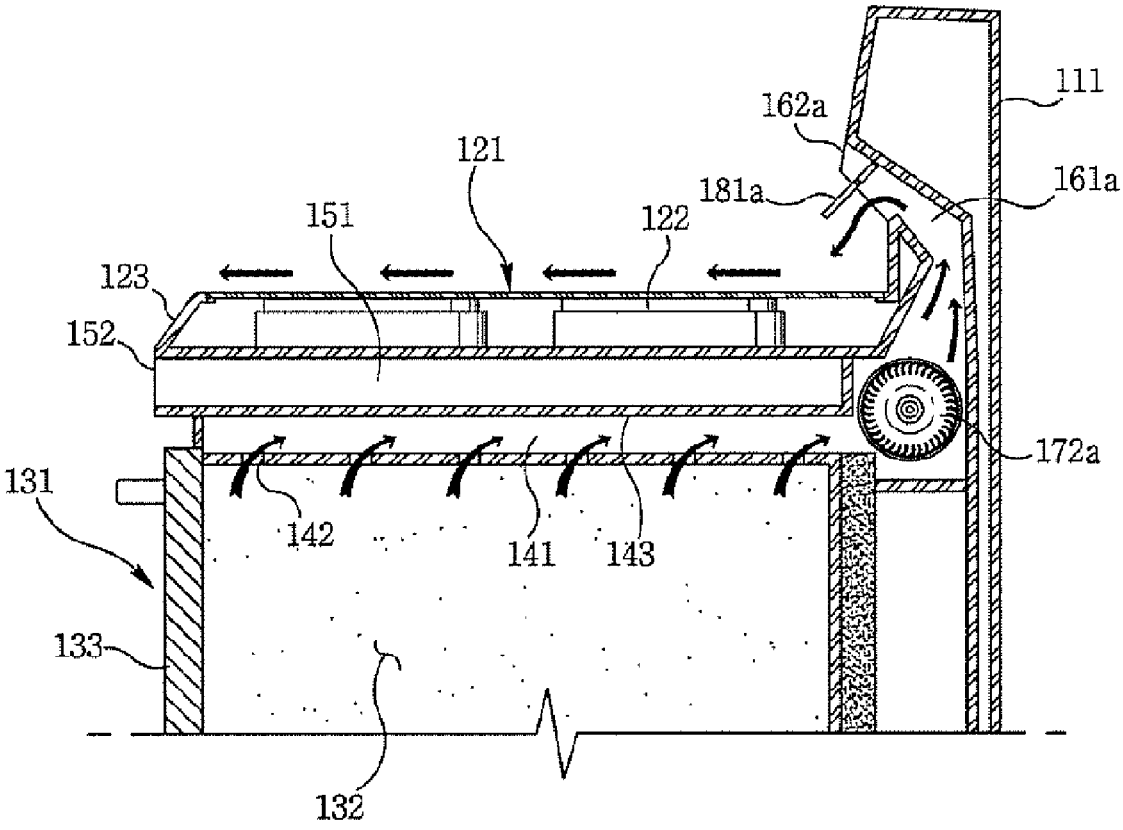

A composite cooking apparatus according to another embodiment of the present invention is illustrated with reference to FIGS. 7 to 11, wherein FIG. 7 is an external perspective view illustrating a composite cooking apparatus, FIG. 8 is a perspective view illustrating part of the composite cooking apparatus illustrated in FIG. 7, and FIGS. 9 and 10 are cross-sectional views of a part of the cooking apparatus taken along line B-B to show a structure and a ventilating operation for radiation of the composite cooking apparatus illustrated in FIG. 7.

Figure 11:
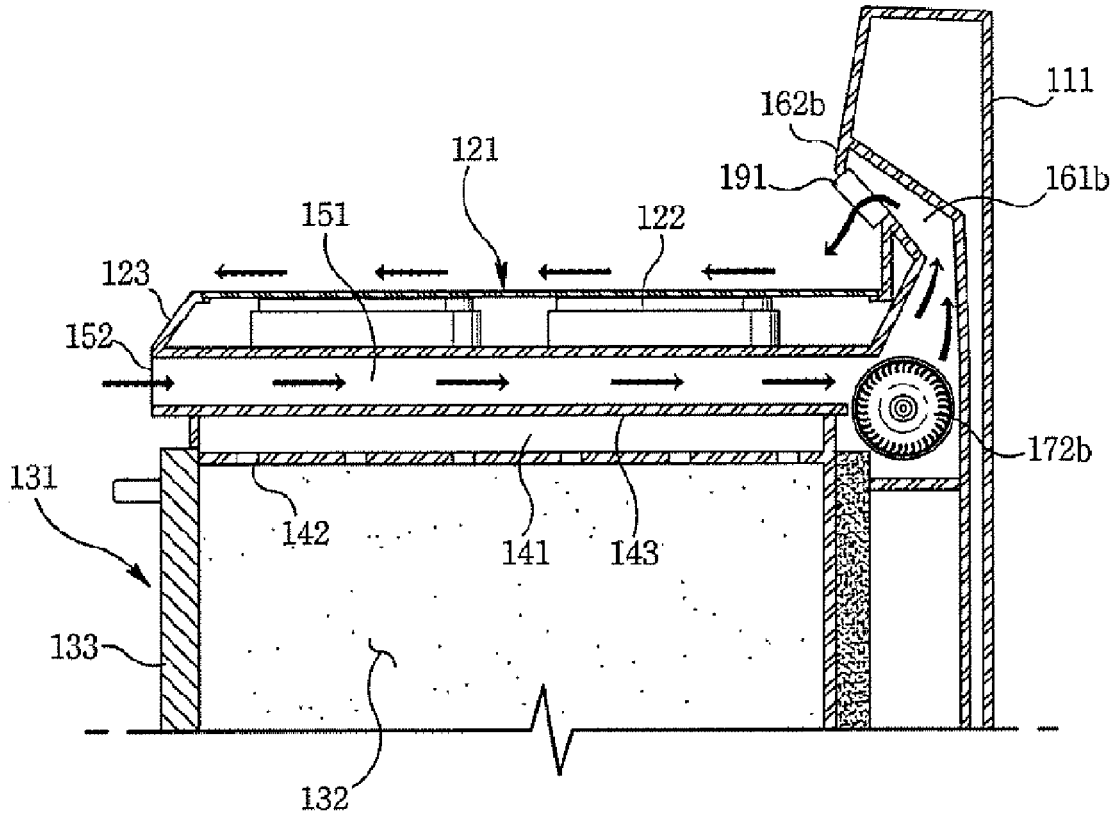
FIG. 11 is a cross-sectional view of a principal part taken along line C-C to illustrate a structure and a ventilating operation for radiation of the composite cooking apparatus in FIG. 7.

FIG. 11 is a cross-sectional view of a part of the cooking apparatus taken along line C-C to illustrate a structure and a ventilating operation for radiation of the composite cooking apparatus in FIG. 7.

Referring to the drawings, a pair of air discharge duct 161*a* has a path structure of being separately connected to a first air inflow duct 141 and a second air inflow duct 152, and an air guide 191 is installed toward a cook-top cooker 131.

The first air discharge duct 161*a* may be connected downstream of the first air inflow duct 141 that communicates with an oven type cooker apparatus 131 to form a air path, and an second air discharge duct 161*b* may be connected downstream of a second air duct inflow duct 151 for introducing outside air to form a separate air path.

Downstream of the first air discharge duct 161*a* and the second air discharge duct 161*b* are respectively disposed with a first outlet 162*a* and a second outlet 162*b* to allow air introduced to the first air discharge duct 611*a* and the second air discharge duct 161*b* to be discharged through the first outlet 162*a* and the second outlet 162*b*.

As a result, the first air inflow duct 141 and the second air inflow duct 151 may have separate air paths through which air flows.

Here, the first outlet 162*a* of the first air discharge duct 161*a* connected to the first air inflow duct 141 may be formed with a blowing direction control 181 that operates as in the same manner as that of the above-mentioned embodiment, the second outlet 162*b* of the second air discharge duct 161*b* connected to the second air inflow duct 151 may have an air guide 191 that faces downward.

The first outlet 162*a* of the first air discharge duct 161*a* may include the blowing direction control 181. The blowing direction control 181 may includes a rotation guide 185, an operation motor 182, a pinion 183, and a gear member 184, and a rotation angle of the rotation guide 185 may be determined by the operation of the operation motor 182 as described in the embodiment above.

On the other hand, an air guide 191 may be provided on the second outlet 162*b* of the second air discharge duct 161*b*. The air guide may serve to guide the air exhausted through the second outlet 162*b* as the second outlet 162*b* has a downward opening structure, being installed on the opened part.

Referring to FIGS. 7 and 8, a distal end of the second outlet 162*b* may be downwardly opened on a back guard 111. The air guide 191 has a structure evenly dispersing the air discharged from the second outlet 162*b* over a surface of the cook-top type cooker 121. For instance, the air guide 191 may have a structure just like a louver apparatus of an air conditioner. The air guide 191 may be also rotatably provided.

As noted above, if the first air discharge duct 161*a* and the second air discharge duct 161*b* are connected to the first inflow duct 141 and the second inflow duct 151, a first blowing fan unit 171*a* and a second blowing fan unit 171*b* are respectively installed about the first outlet 162*a* and the second outlet 162*b*.

Here, the blowing fans respectively arranged on the first blowing fan unit 171*a* and the second blowing fan unit 171*b* may come in various forms of fans such as a sirocco fan, a cross flow fan and the like. Preferably, the sirocco fan or the cross flow fan may be disposed thereabout with a guide duct for inhaling air.

Therefore, the first outlet 162*a* of the first air discharge duct 161*a* can control a vertical air flow while the second outlet 162*b* of the second discharge duct 161*b* provides a fixed type of air flow.

Hereinafter a ventilation condition will be described in detail when the first blowing fan unit 171*a* is operated for cooling operation following operation of the oven type cooker 131 and the cook-top type cooker 121.

First, when the oven type cooker 131 is cooled, the hot air in a chamber 132 of the oven type cooker 131 may be discharged by operation of the first blowing fan unit 171*a*, as shown in FIG. 9.

The air in the chamber 132 may be heated to maintain a high temperature when the oven type cooker 131 is employed, and the air contains odor generated by foods cooked. Under this condition, the air in the chamber 132 starts to be discharged when the first blowing fan unit 171*a* equipped downstream of the first air inflow duct 141 is operated.

The air in the chamber 132 may be introduced into the first air inflow duct 141 through the inflow holes 142 of the first air inflow duct 141 when the blowing fan unit 171*a* is operated, and then is discharge after passing through the first blowing fan 172*a* and the first air discharge duct 161*a*. The cooling may be achieved much faster than, e.g., by natural exhausting as the air in the chamber 132 is compulsorily discharged by operation of the first blowing fan 172*a* to thereby cool the oven type cooker 131.

Further, the air discharged from the oven type cooker 131 may be exhausted upward of the hack guard 111 by control of the blowing direction control means 181.

Further, cooling of the cook-top type cooker 121 is shown in FIG. 11.

For example, the cook-top type cooker 121 may have a relatively high temperature right after its use. At this time, the cook-top type cooker 121 may be cooled with an outside air introduced into the cook-top type cooker 121 through the second outlet 162*b* when the second blowing fan unit 172*b* of the second air inflow duct 151 is operated.

In the aforementioned case, the outside air flows into the second air inflow duct 151 through the inlet 152 when the blowing fan unit 171*b* is operated, and is exhausted via the second blowing fan 172*h* and through the second air discharge duct 161*b* and the second outlet 162*b*.

The air exhausted from the second outlet 162*b* may be distributed evenly over the cook-top type cooker 121 as it is dispersed downwardly by the air guide 191. The exhausted air flows through the air guide 191 as the outlet 162*b* is opened downwardly, and the air guide is equipped thereinside in parallel with the outlet. At this time, the air may be dispersed evenly over the surface of the cook-top type cooker 121 because the air guide 191 has a structure of equally controlling the air current. Therefore, the cook-top type cooker 121 can be cooled rapidly as the outer air is directly supplied to the cook-top type cooker 121.

Furthermore, both the oven type cooker 131 and the cook-top type cooker 121 may be operated to allow the air to be simultaneously discharged through the first outlet 162*a* and the second outlet 162*b*. In this case, the air is discharged upwardly through the first outlet 162*a* and discharged downwardly through the second outlet 162*b* as the operations of FIGS. 9 and 11 are performed at the same time, so that radiation of heat from the oven type cooker 131 and cooling of the cook-top type cooker 121 can be achieved at the same time.

Meanwhile, in case of cooking the cook-top type cooker 121, the cooling operation may be promoted faster by discharging the air inside the oven type cooker 131 to the cook-top type cooker 121.

A temperature inside the oven type cooker 131 may be similar to a normal temperature if the oven type cooker 131 is not used for a long time. At this time, the blowing fan unit 171*a* of the first outlet 162*a* may be operated and the rotation guide 185 may be adjusted to be perpendicular to the air outlet duct 161*b* to allow the air to be discharged to the cook-top type cooker 121. When the first blowing fan unit 171*a* is operated, the air of the oven type cooker 131 is discharged to the first outlet duct 161*a* after being introduced into the first air inlet duct 141 as described above. At the same time, the operation motor 182 sets the rotation guide 185 in motion to position the rotation guide 185 at right angle with the second air outlet duct 161*b* as illustrated in FIG. 10. At this time, the air exhausted from the first outlet duct 161*a* is not exhausted upward by hitting and being blocked by the rotation guide 185, instead, the air is exhausted to the cook-top type cooker 121. As a result, the cook-ton type cooker 121 is cooled much faster as the cooling operation is doubled with the cooling operation of the air exhausted through the second outlet 162*b* and the cooling operation of the air exhausted through the first outlet 162*a*.

It should be appreciated that the composite cooking apparatus, as discussed above, has several advantages including but not limited to the advantages discussed below.

For example, the cook-top type cooker of the composite cooking apparatus may be cooled rapidly by supplying an inhaled unheated outside air to the cook-top type cooker. Therefore, safety problems such as burns and the like that occur as a user contacts an un-cooled cook-type cooker can be prevented in advance.

Another advantage is that the cooling operation of the cook-top type cooker can be improved by blocking the transfer of heat generated from the oven type cooker to the cook-top type cooker can be avoided because an outside air flows underneath the cook-top type cocker.

Still another advantage is that the oven type cooker can quickly cook foods, and the odor generated in the course of food-cooking in the oven type cooker can be effectively discharged to outside as convection performance of the oven is improved by effectively discharging the heat generated from the chamber of the oven type cocker.

It is further noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A cooking apparatus comprising:

an oven cooker;

a cook-top cooker provided on an upper side of the oven cooker;

a first air inflow duct provided between the oven cooker and the cook-top cooker, and communicating with an inside of the oven cooker, and arranged in parallel with and above an upper surface of the oven cooker;

a second air inflow duct separately provided on the oven cooker in parallel with the first air inflow duct;

an air discharge duct communicating with the first and second air inflow ducts, the air discharge duct having an outlet provided above the cook-top cooker, the air discharge duct being arranged at the rear side of the cook-top cooker; and a blowing fan provided in a flow path of the air discharge duct, wherein an air direction controller is provided proximate the outlet of the air discharge duct, and wherein the air direction controller comprises a rotating guide rotatably provided on the air discharge duct, and a drive unit that rotates the rotating guide.

2. The cooking apparatus according to claim 1, wherein the first air inflow duct and the second air inflow duct are stacked one on top of the other.

3. The cooking apparatus according to claim 1, wherein the first and the second air inflow ducts are provided substantially at the same height with respect to a bottom of the cooking apparatus.

4. The cooking apparatus according to claim 1, wherein the rotating guide has a generally planar shape and is hinged at both ends thereof such that the rotating guide is configured to rotate at the outlet of the air discharge duct.

5. The cocking apparatus according to claim 1, wherein the drive unit comprises:

a motor;

a pinion provided on an output shaft of the motor; and a gear that engages the pinion, wherein the gear is connected to the rotating guide.

6. The cooking apparatus according claim 1, wherein the second air inflow duct comprises an inflow inlet that inhales an outside air, and is provided on either one of a front or a side surface of the cooking apparatus.

7. The cooking apparatus according claim 6, further comprising a protection cover provided in the inflow inlet to prevent foreign objects from entering the second air inflow duct.

8. The cooking apparatus according claim 1, further comprising a separating wall that separates the first air inflow duct from the second air inflow duct.

9. A cooking apparatus comprising:

an oven cooker;

a cook-top cooker provided on an upper side of the oven cooker;

a first air inflow duct interposed between the oven cooker and the cook top cooker, and communicating with an inside of the oven cooker, and arranged in parallel with and above an upper surface of the oven cooker;

a second air inflow duct separately provided and arranged in parallel on an upper surface of the first air inflow duct;

a first air discharge duct that communicates with the first air inflow duct;

a second air discharge duct that communicates with the second air inflow duct, wherein the second air discharge duct is separately provided from the first air discharge duct;

a first blowing fan provided proximate the first air discharge duct; and a second blowing fan provided proximate the second air discharge duct, wherein an air direction controller is provided proximate the outlet of the first air discharge duct, and wherein the air direction controller comprises a rotating guide rotatably provided proximate the air discharge duct and a drive unit that drives the rotating guide.

10. The cooking apparatus according to claim 9, wherein the first air inflow duct and the second air inflow duct are stacked one on top of the other.

11. The cooking apparatus according to claim 10, wherein the first air inflow duct and the second air inflow duct are arranged at substantially the same height with respect to a bottom of the cooking apparatus.

12. The cooking apparatus according to claim 9, wherein the rotating guide has a generally planar shape and is hinged at ends thereof such that the rotating guide is configured to rotate at the outlet of the air discharge duct.

13. The cooking apparatus according claim 9, wherein the drive unit comprises:

a motor;

a pinion provided on an output shaft of the motor; and a gear that engages the pinion, wherein the gear is connected to the rotating guide.

14. The cooking apparatus according to claim 9, wherein the second air discharge duct further comprises, proximate an outlet thereof, an air guide configured to guide air towards a top surface of the cook-top cooker.

15. The cooking apparatus according claim 9, wherein the second air inflow duct comprises an inflow inlet that inhales an outside air, and is provided on either one of a front or a side surface of the cocking apparatus.

16. The cooking apparatus according claim 15, further comprising a protection cover provided in the inflow inlet to prevent foreign objects from entering the second air inflow duct.

* * * * *